United States Patent [19]

Gregory

[11] 4,329,121

[45] May 11, 1982

[54] FORCE DELIVERING HAND TOOL

[76] Inventor: Jack T. Gregory, P.O. Box 556, San Anselmo, Calif. 94960

[21] Appl. No.: 128,239

[22] Filed: Mar. 7, 1980

[51] Int. Cl.[3] ..... F04B 1/18

[52] U.S. Cl. ..... 417/270

[58] Field of Search ..... 417/269–272

[56] References Cited

U.S. PATENT DOCUMENTS

| | | | |
|---|---|---|---|
| 2,913,911 | 11/1959 | Gilkey | 417/269 |
| 3,129,702 | 4/1964 | Arbanas | 417/269 |
| 3,296,976 | 1/1967 | Soefers | 417/269 |

FOREIGN PATENT DOCUMENTS

| | | | |
|---|---|---|---|
| 2324832 | 12/1974 | Fed. Rep. of Germany | 417/269 |
| 1334108 | 10/1963 | France | 417/269 |

*Primary Examiner*—William L. Freeh

*Attorney, Agent, or Firm*—Melvin R. Stidham

[57] ABSTRACT

A hand operated tool comprising a cylinder with a drive piston therein operative to drive the cylinder to deliver a substantial lineal force. The piston has a large, tubular piston rod which functions also as a reservoir for the hydraulic fluid. A plurality of oil passages bored through the drive piston have small pump pistons reciprocable therein to receive on each return stroke a quantity of fluid from the self-contained reservoir to be delivered on the pump stroke to the other side of the drive piston. A wobble plate is mounted on the drive piston to drive the small pump pistons by tilting against them. A motor carried on the trailing end of the tubular piston rod rotates a shaft to drive a wheel carrying tapered pressure rollers around the wobble disc, tilting it against the pump pistons in circumferential sequence.

5 Claims, 4 Drawing Figures

FORCE DELIVERING HAND TOOL

BACKGROUND OF THE INVENTION

There is a substantial need for portable, hand operated, hydraulic tools which are capable of delivering substantial forces for certain heavy duty tasks, such as splitting logs or the like. Generally, such tools cannot be easily manipulated; they require hydraulic pumps, lines and fixtures; and they do not lend themselves to field operation.

OBJECTS OF THE INVENTION

It is an object of this invention to provide a portable hand tool which is capable for delivering a substantial linear force.

It is a further object of this invention to provide a powerful hydraulic tool which does not require exterior pumps and fittings.

It is a further object of this invention to provide a powerful hydraulic hand tool having a self-contained reservoir.

Other objects and advantages of this invention will become apparent from the description to follow, particularly when read in conjunction with the accompanying drawing.

SUMMARY OF THE INVENTION

In carrying out this invention, I provide a drive piston with a cylinder slidable thereon, whereby hydraulic fluid, which is delivered under pressure to one side of the piston will drive the cylinder ahead of it. The piston operates in the self-contained reservoir of hydraulic fluid so that the source is always available. A plurality of piston pumps are arranged around the drive piston, and there is a wobble disc mounted just above it. A wheel having pressure rollers of different diameter roll around the wobble disc to cause it to tilt sequentially around its circumference to operate the piston pumps in sequence. Each piston pump drives a small quantity of oil through a check valve into the cylinder ahead of the drive piston, and then returns to draw more oil. This continues until the end of the work stroke is reached, at which time an exhaust valve is opened to allow a spring to return the cylinder to its initial position.

DESCRIPTION OF A PREFERRED EMBODIMENT

Figure 1:
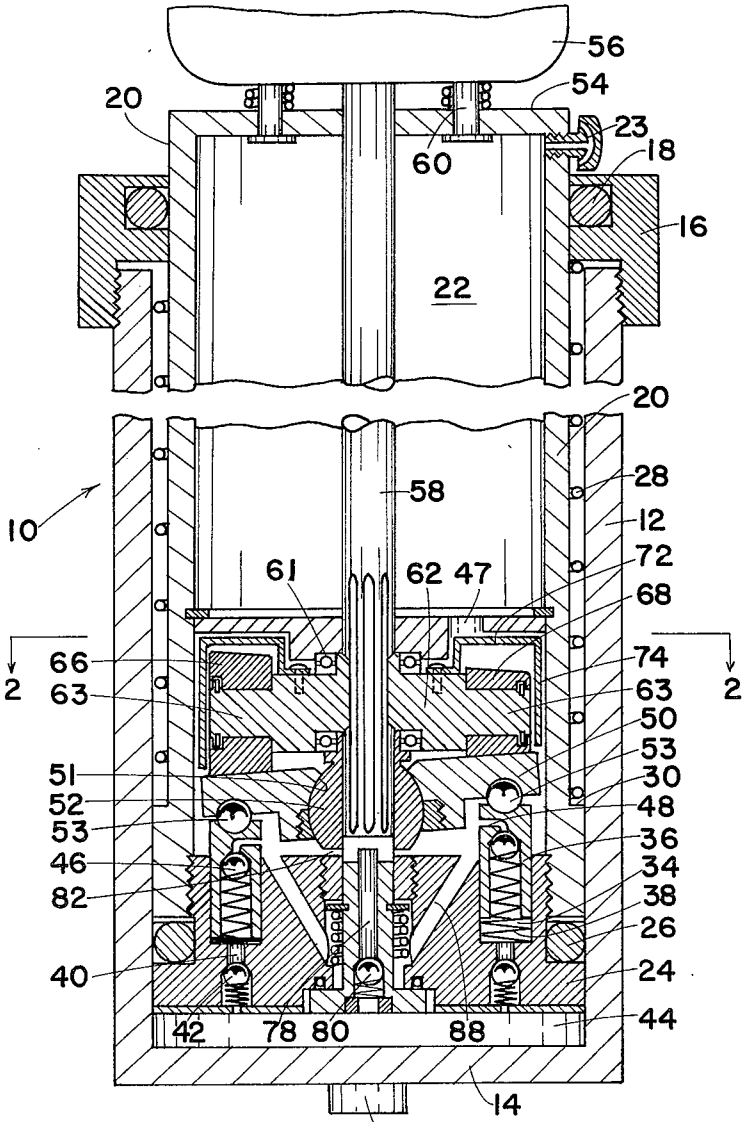
FIG. 1 is a vertical section view of a hydraulic force-applying hand tool in accordance with this invention.

Referring now to FIG. 1 with greater particularity, the portable, hydraulic, hand-operated, force-applying tool 10 of this invention, includes a cylinder 12 which is closed at one end 14. A cap 16 secured at the other end of the cylinder 12 carries a suitable seal ring 18 to seal around a large hollow cylindrical piston rod 20, which functions also as the self-contained oil reservoir 22, which may be vented at 23. Carried at the lower end of the cylindrical piston rod 20 is a work or drive piston 24 carrying seals 26 to seal against the inner surface of the cylinder 12. A relatively heavy spring 28 which is carried between a shoulder 30 on the piston rod and the cap 16, biases the piston 24 downward or, more properly it biases the cylinder 12 upward, to substantially the piston shown in FIG. 1.

Extending through the piston 24 is a plurality of inlet passageways 34 in which a plurality of pump pistons 36 reciprocate, each pump piston being biased into its upper position by means of a spring 38. As each pump piston is driven downward, by means hereinafter to be described, a quantity of fluid, which is readily available from the self-contained reservoir, is forced through the outlet passage 40 to unseat a ball check valve 42 and move into the power chamber 44 below the drive piston 24. During this movement, a second ball check 46 in the pump piston prevents return of the fluid to the reservoir 22 which communicates at 47 with the area of the drive piston 24 in which the pump pistons 36 are contained.

Then, as each pump piston 36 is again moved to its upper position shown at the right, a quantity of fluid is drawn through the inlet passage 48 past the ball check 46 to fill the chamber between the two ball checks 46 and 42, preparing the pump piston 36 for its pumping strokes.

A wobble disc 50 having a spherical internal bearing surface 51 to swivel on a ball 52 carried on the drive piston 24, operates when tilted to force pump pistons at one side down, through the medium of ball actuators 53, allowing the spring-biased pump pistons 36 on the opposite side to move up. It will thus be seen that if the wobble disc tilts progressively around its circumference, the pump pistons 36 will, likewise operate in circumferential sequence.

Mounted on the top 54 of the hollow piston rod 20 is a suitable rotary drive means such as a motor 56, which rotates a drive shaft 58 at substantial speed. The motor 56 and the shaft 58*a* are also adapted for limited axial movement on the piston rod 20 as by mounting the motor on spring-biased legs 60.

Figure 2:
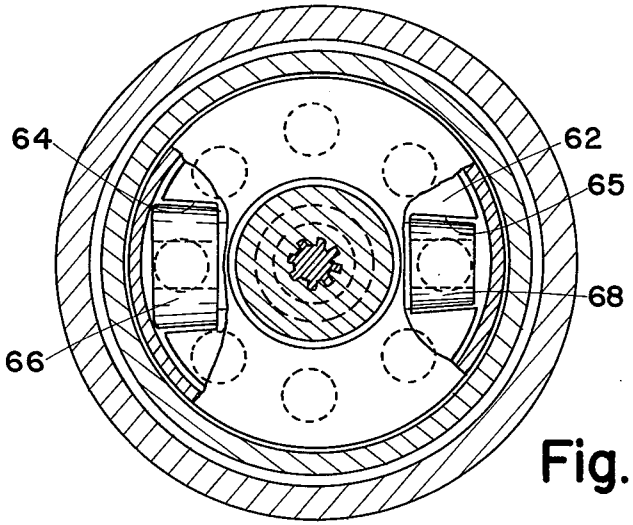
FIG. 2 is a section view taken along line 2—2 of FIG. 1.

At the bottom of the drive shaft 54 is splined a relatively heavy wheel 62, and rotatably carried on stub shafts 63 in recesses 64 and 65 (FIG. 2) at diametrically opposite sides of the wheel 62 are tapered rollers 66 and 68 of different diameter. In effect, the taper of the small roller 68 forms a continuation or projection of the taper of the large roller 64 and both engage the wobble disc 50, as previously described.

Hence, as the wheel 62 rotates, the rollers 66 and 68 roll along the top surface of the wobble disc 50, causing it to tilt in circumferential progression to depress the pump pistons 36 against their springs 38, through the ball actuators 53. As a result, small charges of oil are transferred from one side of the work piston 24 to the other, being projected into the power chamber 44 in very rapid succession to drive the cylinder 12 downward and produce a substantial force through an appropriate work member, which may be attached to the cylinder 12 at 70.

The recesses 64 and 65 in which the rollers 66 and 68 are contained compensate for the different roller masses in order to maintain wheel balance. Moreover, with the rollers so housed, there is a streamlining effect to minimize turbulence. In addition, a thin metal, annular cowl or hood 72, having a depending skirt 74 is secured to the wheel 62 to enclose the rollers 66 and 68 almost completely, further reducing turbulence.

Figure 4:
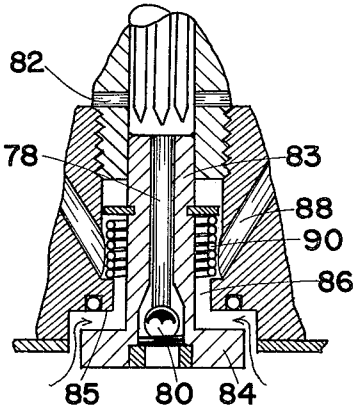
FIGS. 3 and 4 are enlarged partial section views of the exhaust valve in different stages of operation.
Figure 3:
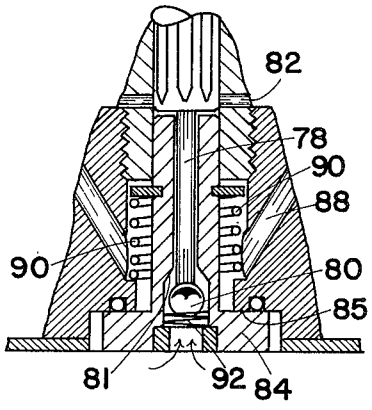

When the work member 70 reaches the end of its stroke, the motor 56 is stopped and then depressed to move the drive shaft 58 axially downward. Referring now to FIGS. 3 and 4 such movement will first result in engagement with a push rod 78 which forces ball check 80 away from its seat 81 to relieve, through suitable vents 82, the tremendously high pressure below the drive piston 24. The push rod 78 is slidable in the steam 83 of a larger poppit-type relief valve 84, so that continued movement of the drive shaft 58 to the position shown in FIG. 4 will depress the stem 83, and force the relief valve 84 from its seat 85, allowing flow through port 86 and out the exhaust passageways 88.

When the pressure in the power chamber 44 is reduced, the main spring 28 returns the cylinder 12 to its initial position and, when the drive shaft 54 is again raised, the spring 90 will bias the exhaust valve to its initial position shown in FIG. 3 and the spring 92 will return the ball check 80 to its normal position. Thereafter, as the power flow commences this sealing action is supplemented, and in face taken over, by fluid pressure acting against the lower surfaces of the drive piston 24.

While this invention has been described in conjunction with a preferred embodiment thereof, it is obvious that modifications and changes therein may be made by those skilled in the art to which it relates, without departing from the spirit and scope of this invention, as defined by the claims appended thereto.

What is claimed as invention is:

1. A portable lineal force delivering implement comprising:

a cylinder;

a drive piston slidably carried in said cylinder;

a self-contained fluid reservoir in said reservoir on one side of said drive piston and exposed thereto;

a plurality of oil passage bores through said drive piston;

a pump piston slidable in each of said bores with an inlet end thereof protruding from said bore on said one side of the drive piston;

inlet passageways through each of said pump pistons from said inlet end;

an inlet one-way check valve in each of said inlet passageways enabling flow from said inlet end only;

an outlet one-way check valve in each of said bores downstream of the pump piston therein, enabling downstream flow only;

a coaxial drive shaft rotatable in said cylinder;

pump piston-actuating means operative to extend said pump pistons;

a wheel splined onto said shaft;

diametrically opposed recesses in said wheel;

a radial shafts in said recesses;

a large pressure roller on one of said shafts engaged with said actuating means and a smaller guide roller on the other of said shafts;

an annular cowl on said wheel with a depending peripheral skirt to enclose said wheel, recesses and rollers.

2. A portable lineal force delivering implement comprising:

a cylinder;

a drive piston slidably carried in said cylinder;

a self-contained fluid reservoir in said reservoir on one side of said drive piston and exposed thereto;

a plurality of oil passage bores through said drive piston;

a pump piston slidable in each of said bores with an inlet end thereof protruding from said bore on said one side of the drive piston;

inlet passageways through each of said pump pistons from said inlet end;

an inlet one-way check valve in each of said inlet passageways enabling flow from said inlet end only;

an outlet one-way check valve in each of said bores downstream of the pump piston therein, enabling downstream flow only;

a coaxial drive shaft rotatable in said cylinder;

pump piston-actuating means operative to extend said pump pistons;

means on said drive shaft engagable with said actuating means to operate same sequentially;

said drive shaft being axially slidable on said drive piston;

at least one exhaust passageway through said drive piston extending from an exhaust port at the working face thereof;

an exhaust valve engagable around said exhaust port to seal off same;

spring means and fluid pressure acting against said working face normally biasing said exhaust valve closed; and a stem on said exhaust valve engagable by said drive shaft when same is moved axially to open said exhaust valve.

3. The implement defined by claim 1 including:

a tubular piston rod carried on said one side of the drive piston forming said reservoir.

4. The implement defined by claim 1 including:

a relieving passageway extending axially through said stem;

a relieving check valve in said relieving passageway normally preventing flow therethrough; and a rod in said relieving passageway engaging said relieving check valve and extending beyond said valve stem whereby said drive shaft engages said rod and opens said relieving check valve before it engages said valve stem.

5. The implement defined by claim 1 wherein said piston-actuating means comprises a wobble disc mounted on said pistons;

said rollers being engagable to roll around said wobble disc; and force transmitting members on said wobble disc, each engaging one of said pump pistons.

* * * * *